US010627054B2

(12) United States Patent
Baright et al.

(10) Patent No.: US 10,627,054 B2
(45) Date of Patent: Apr. 21, 2020

(54) LIGHTING FIXTURE HOUSING, ADAPTER, AND RETROFIT SYSTEM

(71) Applicant: G&G LED, LLC, Clifton Park, NY (US)

(72) Inventors: Jason Baright, Saratoga Springs, NY (US); Sasi Kothakota, Clifton Park, NY (US)

(73) Assignee: G&G LED, LLC, Clifton Park, NY (US)

( * ) Notice: Subject to any disclaimer, the term of this patent is extended or adjusted under 35 U.S.C. 154(b) by 0 days.

(21) Appl. No.: 16/136,135

(22) Filed: Sep. 19, 2018

(65) Prior Publication Data

US 2020/0088357 A1 Mar. 19, 2020

(51) Int. Cl.

| | |
|---|---|
| ***F21V 21/00*** | (2006.01) |
| ***F21K 9/272*** | (2016.01) |
| ***H01R 33/94*** | (2006.01) |
| ***F21K 9/275*** | (2016.01) |
| *F21Y 115/10* | (2016.01) |

(52) U.S. Cl.

CPC ..... *F21K 9/272* (2016.08); *F21K 9/275* (2016.08); *H01R 33/94* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 7,052,171 | B1 | 5/2006 | Lefebvre et al. | |
| 7,549,787 | B1 | 6/2009 | Blaymore | |
| 8,319,407 | B2 | 11/2012 | Ke | |
| 8,636,391 | B2 * | 1/2014 | Dellian | H01R 33/96 362/217.01 |
| 8,858,019 | B2 | 10/2014 | Novak et al. | |
| 9,004,716 | B2 | 4/2015 | Ai | |
| 9,004,948 | B2 * | 4/2015 | Tsai | F21V 21/14 439/612 |
| 9,335,008 | B2 | 5/2016 | Fujita et al. | |
| 2009/0091929 | A1 | 4/2009 | Faubion | |
| 2017/0023186 | A1 | 1/2017 | Norton et al. | |

FOREIGN PATENT DOCUMENTS

| | | | |
|---|---|---|---|
| JP | 2013084527 | A | 5/2013 |
| JP | 2013110085 | A | 6/2013 |
| JP | 2015005457 | A | 1/2015 |
| JP | 2016177939 | A | 10/2016 |
| JP | 6131734 | B2 | 5/2017 |
| WO | 2012032454 | A1 | 3/2012 |

* cited by examiner

*Primary Examiner* — Vip Patel

(74) *Attorney, Agent, or Firm* — Hoffman Warnick LLC

(57) ABSTRACT

Embodiments of the invention relate generally to lighting fixtures and, more particularly, to lighting device housings, systems for retrofitting lighting fixtures, and adapters for use in such retrofitting systems.

16 Claims, 7 Drawing Sheets

LIGHTING FIXTURE HOUSING, ADAPTER, AND RETROFIT SYSTEM

BACKGROUND OF THE INVENTION

Embodiments of the invention relate generally to lighting fixtures and, more particularly, to lighting device housings, systems for retrofitting lighting fixtures, and adapters for use in such retrofitting systems.

Many existing lighting fixtures include lamp holders for securing and supplying power to elongate lighting devices. Many older such fixtures include lamp holders that include a single connector "pin" through which electrical power is supplied. In the case of a lighting device housing containing a fluorescent lighting device, such an arrangement is generally sufficient because fluorescent lighting devices emit light radially in all directions. This makes the orientation of the lighting device housing about its longitudinal axis of no importance to the operation of the lighting fixture.

In an effort to reduce costs and improve energy efficiency, many such fluorescent lighting devices are being replaced with light-emitting diode (LED) lighting devices. Typically, this involves replacing the lighting device itself. With LED lighting devices, however, the orientation of the lighting device housing about its longitudinal axis is of great importance because LED lighting devices generally emit light in a restricted radial direction, typically not more than 180° about its longitudinal axis. Thus, the single-pin lamp holders found on many lighting fixtures are not suitable for use with lighting device housings containing LEDs. This is particularly true in environments subject to vibration or other forces which might cause the housing to turn about its longitudinal axis when connected to a single-pin lamp holder.

SUMMARY

In one aspect, the invention provides a housing for a lighting device, the housing comprising: an elongate substantially tubular member having a first end and a second end; a first end cap at the first end of the tubular member; a second end cap at the second end of the tubular member, wherein at least one of the first and second end caps includes: a substantially cylindrical body; at least one projection extending axially from a distal circumferential edge of the body; and an electrical connector extending axially from a central portion of the body.

In another aspect, the invention provides an adapter for a lighting fixture, the adapter comprising: a ring-shaped body having a first annular edge and a second annular edge; an arcuate projection extending laterally from the first annular edge; and a notch extending medially from the second annular edge.

In yet another aspect, the invention provides a lighting device retrofit system comprising: an adapter, comprising: a ring-shaped body having a first annular edge and a second annular edge; an arcuate projection extending laterally from the first annular edge; and a notch extending medially from the second annular edge; and a lighting device housing, comprising: an elongate substantially tubular member having a first end and a second end; a first end cap at the first end of the tubular member; a second end cap at the second end of the tubular member, wherein at least one of the first and second end caps includes: a substantially cylindrical body; at least one arcuate projection extending axially from a distal circumferential edge of the body; and an electrical connector extending axially from a central portion of the body.

In still another aspect, the invention provides a housing for a lighting device, the housing comprising: an elongate substantially tubular member having a first end and a second end; a first end cap at the first end of the tubular member; a second end cap at the second end of the tubular member, wherein at least one of the first and second end caps includes: a substantially cylindrical body; at least one recess extending inward from a distal circumferential edge of the body; and an electrical connector extending axially from a central portion of the body.

In another aspect, the invention provides a lighting device retrofit system comprising: an adapter, comprising: a ring-shaped body having a first annular edge and a second annular edge; an arcuate projection extending laterally from the first annular edge; and a notch extending medially from the second annular edge; and a lighting device housing, comprising: an elongate substantially tubular member having a first end and a second end; a first end cap at the first end of the tubular member; a second end cap at the second end of the tubular member, wherein at least one of the first and second end caps includes: a substantially cylindrical body; at least one recess extending inward from a distal circumferential edge of the body; and an electrical connector extending axially from a central portion of the body.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
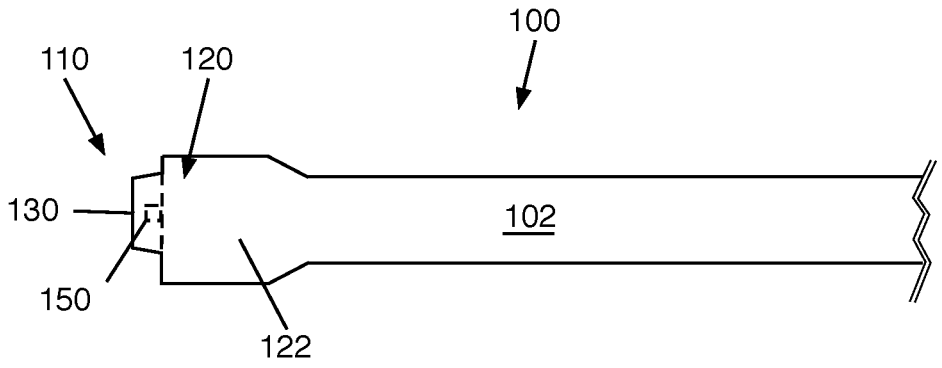
FIG. 1 shows a schematic side view of a lighting device housing according to an embodiment of the invention.

Turning now to the drawings, FIG. 1 shows a schematic side view of a housing 100 according to an embodiment of the invention. Housing 100 includes an elongate, substantially tubular member 102 in which a lighting device may be housed. As will be apparent to one skilled in the art, any number and type of lighting device may be contained within housing 100, including, for example, LEDs. The particular type and number of lighting devices to be contained within housing 100 is of no consequence with respect to the embodiments of the invention described herein.

Housing 100 includes an end cap at either end of tubular member 102. For the sake of simplicity, only one end cap 120 is shown at a first end 110 of tubular member 102. One skilled in the art will recognize, however, that a similarly-described end cap could be located at a second end (not shown) of tubular member 102.

End cap 120 includes a body 122 having a substantially cylindrical shape. At least one projection 130 extends axially from a distal circumferential edge of body 122, as will be described further below. End cap 120 further includes an electrical connector 150 (e.g., a pin) extending axially from a central portion of body 122. As one skilled in the art will understand, electrical connector 150 is electrically connected to wiring and/or circuitry (not shown) within end cap 120 and/or tubular member 102 and is adapted to convey electrical power from a lamp holder to a lighting device within tubular member 102.

Figure 2:
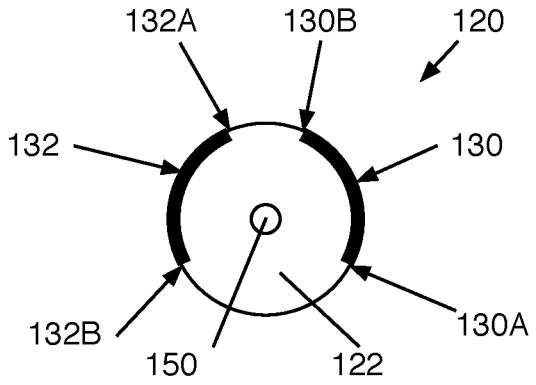
FIG. 2 shows a schematic facing view of the housing of FIG. 1.

FIG. 2 shows a schematic facing view of end cap 120, as if looking along the longitudinal axis of the housing. As can be seen, end cap 120 includes a first projection 130 and a second projection 132 extending axially from a circumferential edge of body 122. Each of first projection 130 and second projection 132 extends from a first end 130A, 132A to a second end 130B, 132B about the circumference of body 122. The lowermost ends—first end 130A of first projection 130 and second end 132A of second projection 132—are positioned in a lower half of body 122 (i.e., below what may be viewed as 3:00 and 9:00 on a clock face). As will be explained in greater detail below, such positioning of the projection ends facilitates securing housing 100 within an existing single-pin lamp holder and preventing rotation of housing 100 about its longitudinal axis.

In the embodiment shown in FIG. 2, first projection 130 and second projection 132 are separated in a lower half of body 122, but also in an upper half of body 122 (i.e., on either side of what may be viewed as 12:00 on a clock face). As will also be explained in greater detail below, such an arrangement facilitates securing housing 100 to a tombstone-style lamp holder or, in combination with an adapter device, to a circular lamp holder.

Figure 3:
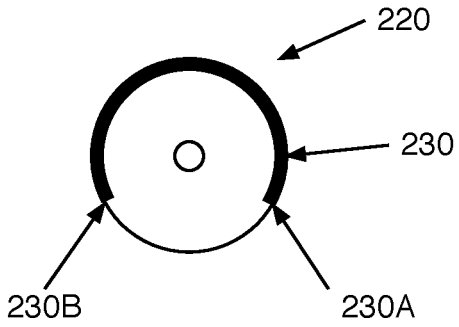
FIG. 3 shows a schematic facing view of a housing according to another embodiment of the invention.

FIG. 3 shows a schematic facing view of an end cap 220 according to an alternate embodiment. Here, end cap 220 includes a single projection 230 extending from a first end 230A to a second end 230B. Such an embodiment may be employed in securing housing 100 to a tombstone-style lamp holder, as will be described below.

Figure 4:
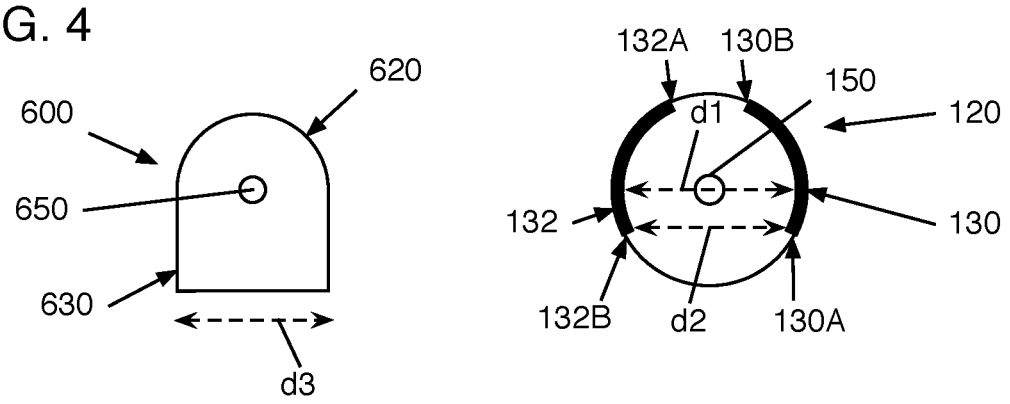
FIG. 4 shows schematic facing views of the housing of FIGS. 1 and 2 in combination with a "tombstone" lamp holder.

FIG. 4 shows a schematic facing view of end cap 120 aside a tombstone-style lamp holder 600. As can be seen, end cap 120 has a first, greatest distance d1 between first projection 130 and second projection 132 at the diameter of end cap 120. A second, shorter distance d2 extends between first end 130A of first projection 130 and second end 132B of second projection 132.

Lamp holder 600 includes an upper first portion 620 having an arcuate or semicircular shape and a lower second portion 630 having a rectangular shape. An electrical receptacle 650 corresponds in shape and is operable to deliver electrical power to electrical connector 150.

Figure 5:
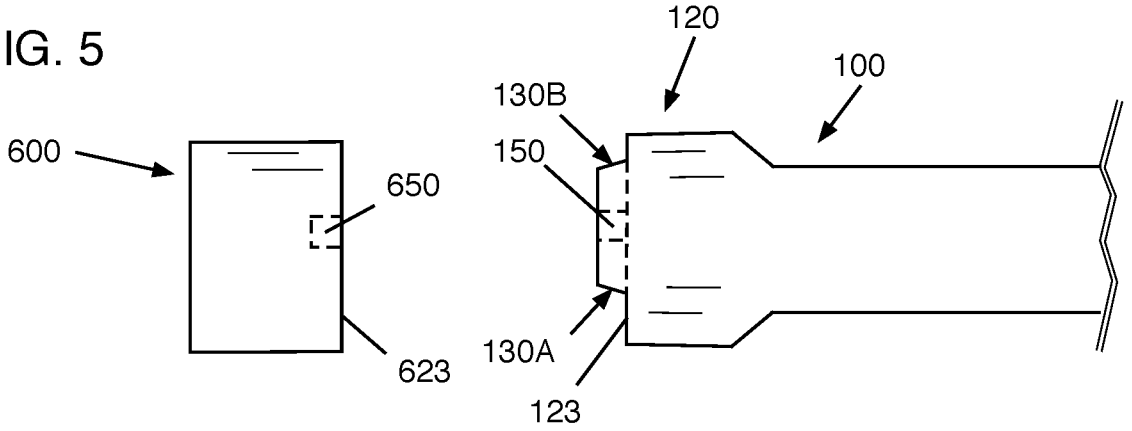
FIG. 5 shows a schematic side view of the housing and lamp holder of FIG. 4.
Figure 6:
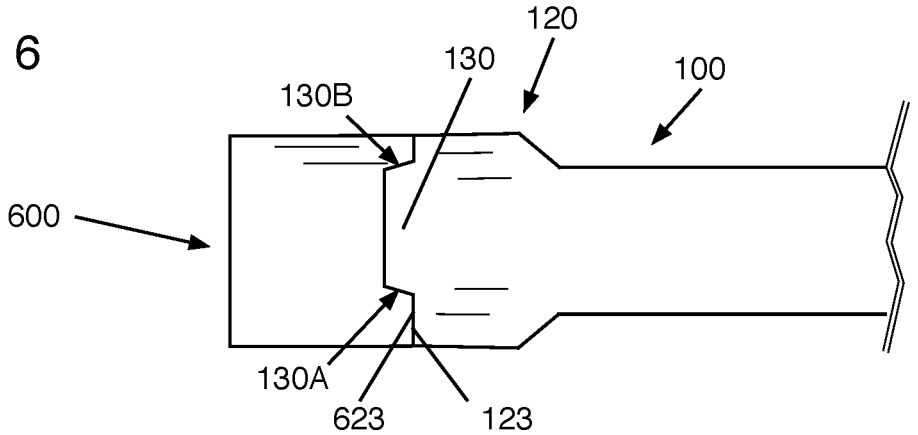
FIG. 6 shows a schematic side view of the housing and lamp holder of FIGS. 4 and 5 when joined.

FIG. 5 shows a schematic side view of housing 100 and lamp holder 600. End cap 120 includes a face 123 that will be brought into contact with a mating face 623 of lamp holder 600. FIG. 6 shows housing 100 and lamp holder 600 in contact. First projection 130 extends beyond mating face 623 of lamp holder 600 and, in combination with second projection 132 (FIG. 4), prevents rotation of holder 100 about its longitudinal axis.

Figure 7:
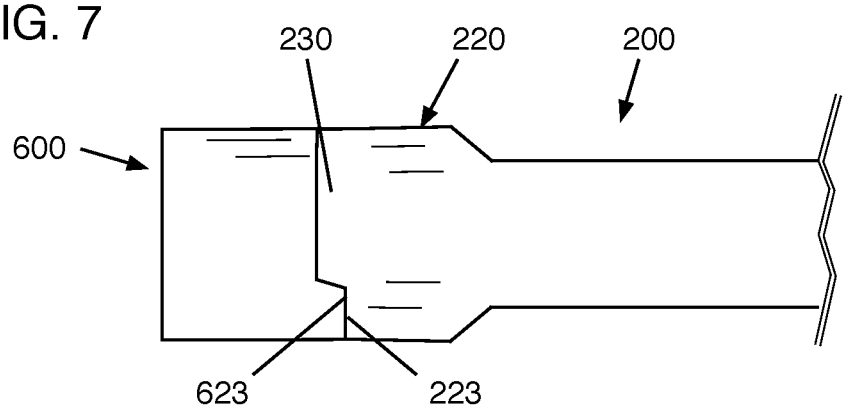
FIG. 7 shows a schematic side view of the housing of FIG. 3 and the lamp holder of FIGS. 4 and 5 when joined.

FIG. 7 shows a schematic side view of housing 200 when brought into contact with lamp holder 600.

Figure 8:
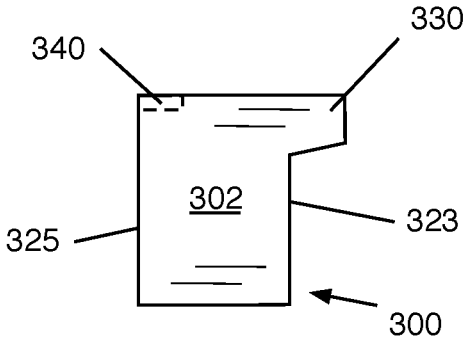
FIG. 8 shows a schematic side view of a lamp holder adapter according to an embodiment of the invention.
Figure 9:
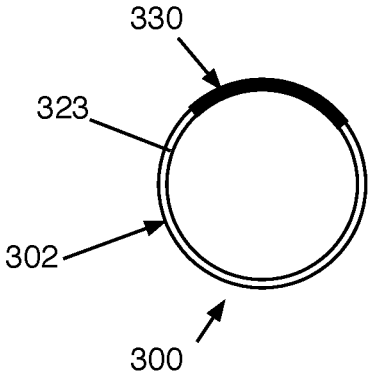
FIG. 9 shows a schematic facing view of the adapter of FIG. 8.
Figure 10:
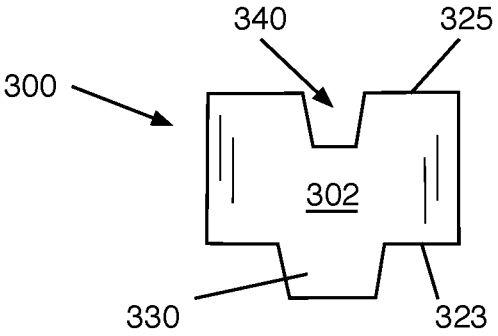
FIG. 10 shows a schematic top view of the adapter of FIGS. 8 and 9.

FIG. 8 shows a schematic side view of an adapter 300 according to another aspect of the invention. Adapter 300 includes a ring-shaped body 302 having a first annular edge 323 and a second annular edge 325, an arcuate projection 330 extending laterally from first annular edge 323, and a notch 340 extending medially from the second annular edge 325. FIG. 9 and FIG. 10 show, respectively, schematic facing and top views of adapter 300.

Figure 11:
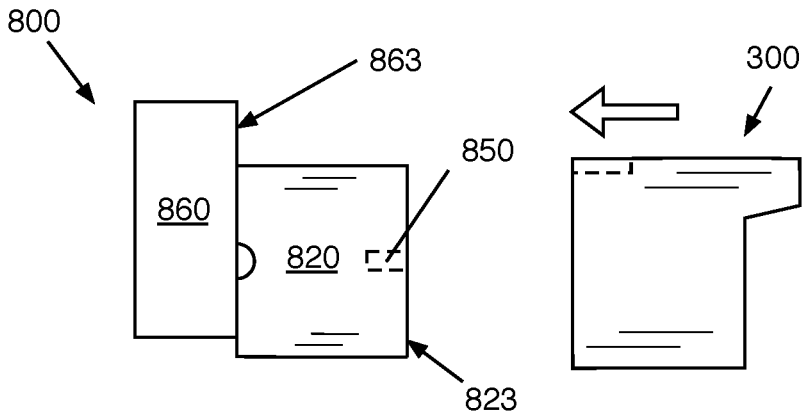
FIG. 11 shows schematic side views of the adapter of FIGS. 8-10 and a circular-style lamp holder.

FIG. 11 shows a schematic side view of adapter 300 aside a circular-style lamp holder 800. Lamp holder 800 includes a circular body 820, an electrical receptacle 850, and a mating face 823, similar to the tombstone-style lamp holder 600 in FIGS. 4-7. Lamp holder 800, however, further includes a pillar 860 having a mating face 863.

Figure 12:
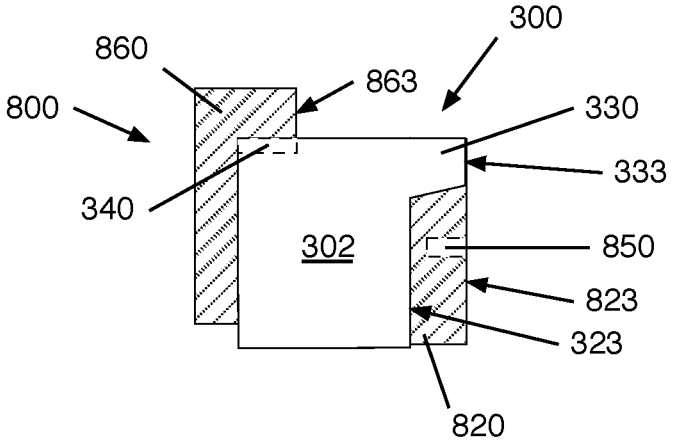
FIG. 12 shows a schematic side view of the adapter and lamp holder of FIG. 11 when joined.
Figure 13:
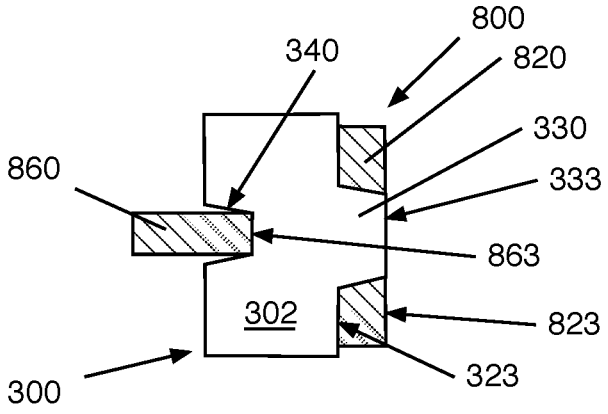
FIG. 13 shows a schematic top view of the adapter and lamp holder of FIGS. 11 and 12 when joined.

FIG. 12 shows a schematic side view of adapter 300 disposed atop lamp holder 800 (shown in hatched fill merely to distinguish it from adapter 300). In such configuration, a distal end 333 of projection 330 is substantially flush with mating face 823 of lamp holder 800 and pillar 860 extends into notch 340 of adapter 300. FIG. 13 shows a schematic top view of the configuration in FIG. 12. As can be seen, mating face 863 of pillar 860 extends fully into notch 340 and serves to stop further axial movement of adapter 300 along body 820 of lamp holder 800. This positioning of pillar 860 within notch 340 also prevents rotation of adapter 300 about a longitudinal axis of lamp holder 800.

Figure 14:
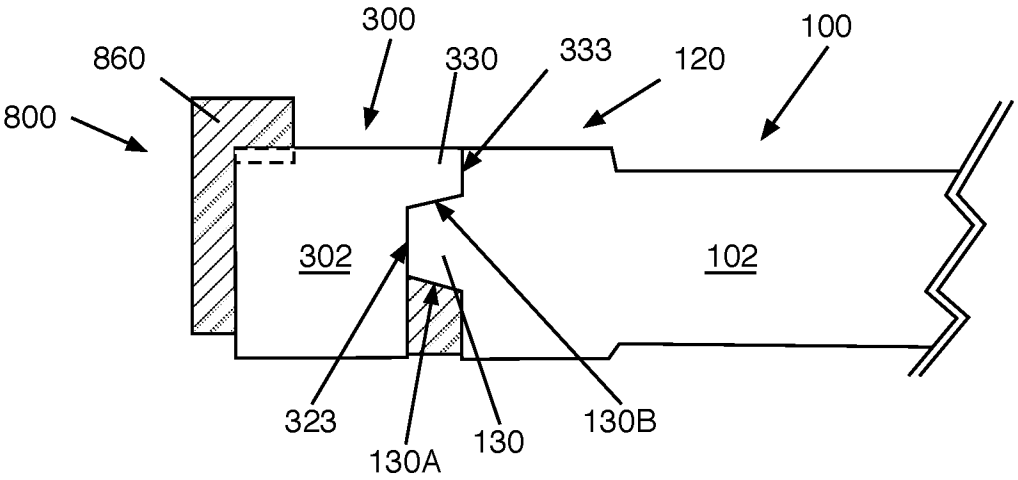
FIG. 14 shows a schematic top view of the joined adapter and lamp holder of FIG. 13 joined with a housing of FIG. 1.
Figure 15:
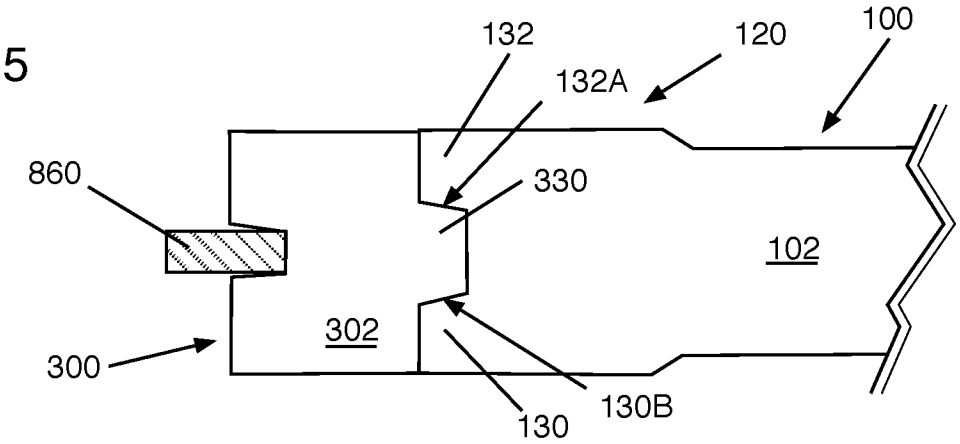
FIG. 15 shows a schematic top view of the adapter, lamp holder, and housing of FIG. 14.

FIG. 14 and FIG. 15 show, respectively, schematic side and top views of a housing 100 in combination with adapter 300 and lamp holder 800. Similar to the arrangement shown in FIG. 6, first projection 130 of end cap 120 abuts projection 330 of adapter 300, thereby preventing rotation of housing 100 about its longitudinal axis. Specifically, second end 130B of first projection and first end 132A of second projection 132 abut either side of projection 330.

As can be seen from the above, the end cap 120 shown in FIGS. 1 and 2 may be used in combination with tombstone-style lamp holders, as in FIGS. 4-6, and also in combination with circular lamp holders, as in FIGS. 14 and 15, when combined with the adapter 300 in FIGS. 8-10.

Figure 16:
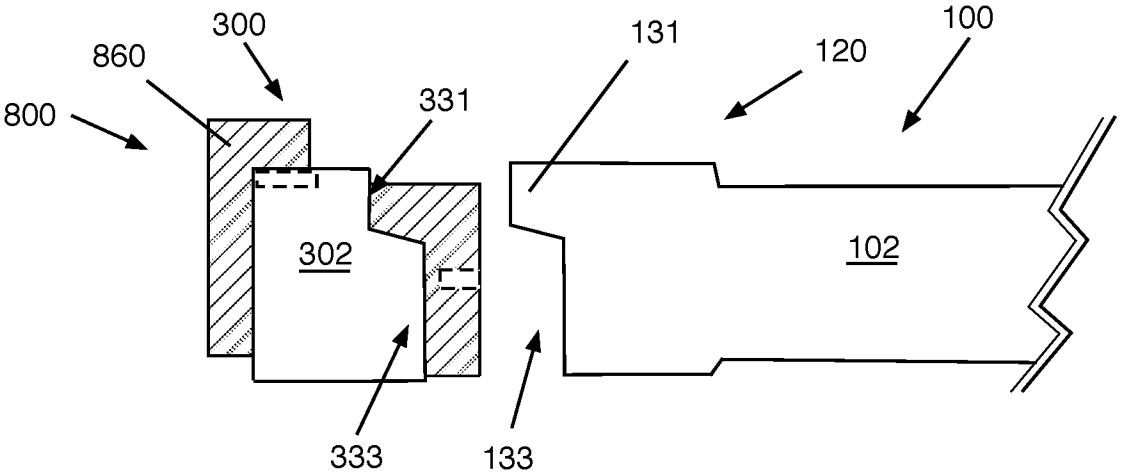
FIGS. 16 and 17 show schematic side views of an adapter and housing according to another embodiment of the invention.

As would be apparent to one skilled in the art, the arrangement of the projections on the housing and/or adapter may be varied in any number of ways without departing from the spirit and scope of the invention. For example, FIGS. 16 and 17 how schematic side views of a housing 100 in combination with an adapter 300 according to another embodiment of the invention. Here, end cap 120 of housing 100 includes a single projection 131 adapted to reside within a recess 331 of adapter body 302.

Of course, these features may alternatively be viewed as their respective counterparts. That is, the portion of end cap 120 that is not projection 131 may be viewed as a recess 133, just as the portion of adapter 300 that is not recess 331 may be viewed as a projection 333. The particular terminology employed in describing these components should not be viewed as limiting. Rather, what matters in terms of the utility of the invention is the complimentary nature of the components of the housing 100 and adapter 300 and their ability to prevent rotation of the housing 100 when those complimentary components are brought into contact.

Figure 17:
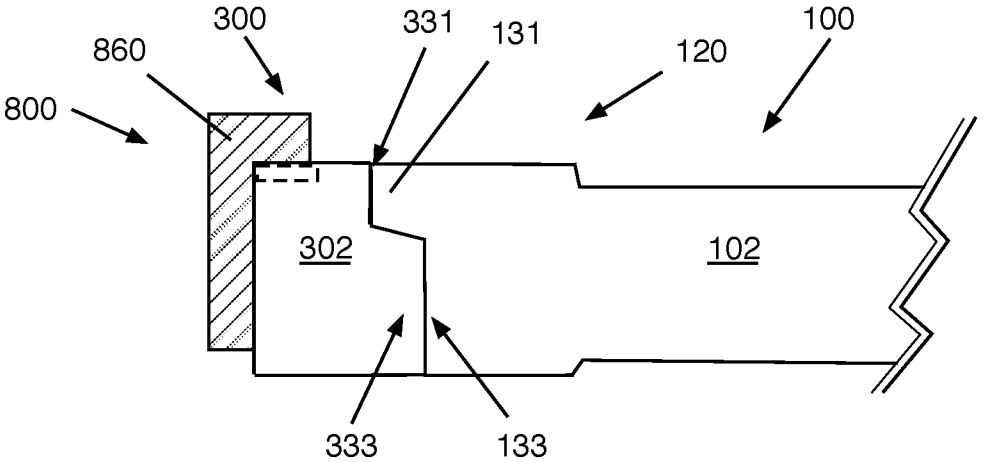

FIG. 17 shows housing 100 and adapter 302 once brought into contact such that projection 131 resides substantially within recess 331, thereby restricting rotation of housing 100 about its longitudinal axis.

Figure 18:
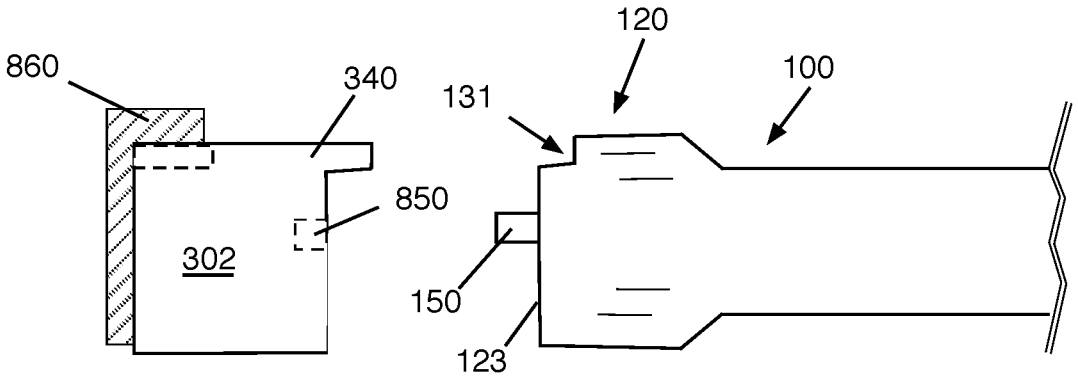
FIGS. 18 and 19 show schematic side and top views of an adapter and housing according to still another embodiment of the invention.
Figure 19:
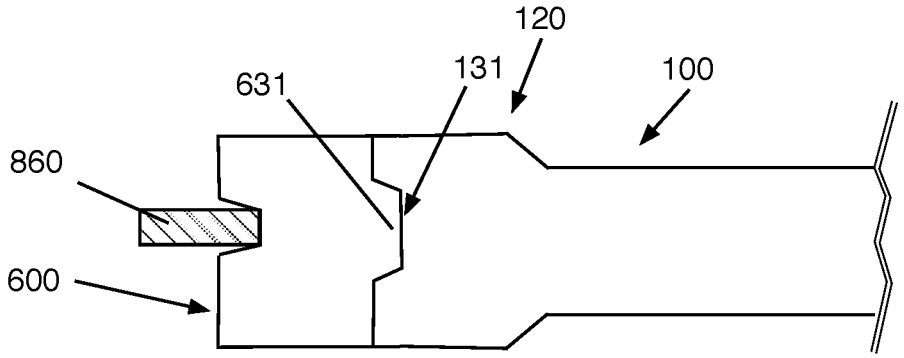

Similarly, FIGS. 18 and 19 show schematic side and top views, respectively, of an adapter 302 and housing 100 according to another embodiment of the invention. As can be seen in FIG. 18, end cap 120 of housing 100 includes no projection, but a recess 131 extending medially inward from face 123. Recess 131 is adapted to receive projection 340 extending outward from adapter 302. FIG. 19 shows a top view of adapter 302 and housing 100 so arranged. As in the embodiments described above, the interaction of projection 340 and recess 131 prevents rotation of housing 100 about its longitudinal axis.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A housing for a lighting device, the housing comprising:

an elongate substantially tubular member having a first end and a second end;

a first end cap at the first end of the tubular member; and a second end cap at the second end of the tubular member, wherein at least one of the first and second end caps includes:

a substantially cylindrical body;

at least one projection extending axially from a distal circumferential edge of the body; and a single electrical connector extending axially from a center of the body.

2. The housing of claim 1, wherein the at least one arcuate projection extends from a first end to a second end more than 180° along the distal circumferential edge.

3. The housing of claim 1, wherein each of the first and second end caps includes a pair of arcuate projections extending axially from the distal circumferential edge of the body.

4. The housing of claim 3, wherein each of the pair of arcuate projections extends from a first end to a second end less than 45° and the pair of arcuate projections are separated by more than 30°.

5. The housing of claim 4, wherein the pair of arcuate projections are separated by less than 45°.

6. An adapter for a lighting fixture, the adapter comprising:

a ring-shaped body having a first annular edge and a second annular edge;

an arcuate projection extending laterally from the first annular edge; and a notch extending medially from the second annular edge.

7. The adapter of claim 6, wherein the arcuate projection extends from a first end to a second end less than 45°.

8. The adapter of claim 7, wherein the notch extends from a first end to a second end, the notch being substantially centered with respect to the arcuate projection.

9. A lighting device retrofit system comprising:

an adapter, comprising:

a ring-shaped body having a first annular edge and a second annular edge;

an arcuate projection extending laterally from the first annular edge; and a notch extending medially from the second annular edge; and a lighting device housing, comprising:

an elongate substantially tubular member having a first end and a second end;

a first end cap at the first end of the tubular member;

a second end cap at the second end of the tubular member, wherein at least one of the first and second end caps includes:

a substantially cylindrical body;

at least one arcuate projection extending axially from a distal circumferential edge of the body; and an electrical connector extending axially from a central portion of the body.

10. The lighting device retrofit system of claim 9, wherein the at least one arcuate projection of each of the first and second end caps extends from a first end to a second end more than 180°.

11. The lighting device retrofit system of claim 9, wherein each of the first and second end caps includes a pair of arcuate projections extending axially from the distal circumferential edge of the body.

12. The lighting device retrofit system of claim 11, wherein each of the pair of arcuate projections extends from a first end to a second end less than 45° and the pair of arcuate projections are separated by more than 30°.

13. The lighting device retrofit system of claim 12, wherein the pair of arcuate projections are separated by less than 45°.

14. The lighting device retrofit system of claim 9, wherein the arcuate projection of the adapter extends from a first end to a second end less than 45°.

15. The lighting device retrofit system of claim 14, wherein the notch extends from a first end to a second end, the notch being substantially centered with respect to the arcuate projection.

16. A lighting device retrofit system comprising:

an adapter, comprising:

a ring-shaped body having a first annular edge and a second annular edge;

an arcuate projection extending laterally from the first annular edge; and a notch extending medially from the second annular edge; and a lighting device housing, comprising:

an elongate substantially tubular member having a first end and a second end;

a first end cap at the first end of the tubular member;

a second end cap at the second end of the tubular member, wherein at least one of the first and second end caps includes:

a substantially cylindrical body;

at least one recess extending inward from a distal circumferential edge of the body; and an electrical connector extending axially from a central portion of the body.

* * * * *